US006561278B2

(12) United States Patent
Restarick et al.

(10) Patent No.: US 6,561,278 B2
(45) Date of Patent: May 13, 2003

(54) METHODS AND APPARATUS FOR INTERCONNECTING WELL TOOL ASSEMBLIES IN CONTINUOUS TUBING STRINGS

(76) Inventors: Henry L. Restarick, 2050 Keller Springs Rd., Carrollton, TX (US) 75006; John C. Gano, 2015 White Ash Rd., Carrollton, TX (US) 75007; Patrick E. Laursen, 2510 Plantation La., Sugar Land, TX (US) 77478; Michael L. Connell, 1315 W. Cedar, Duncan, OK (US) 73533; Nicida Maerefat, 10200 Bellaire Blvd., Houston, TX (US) 77072

( * ) Notice: Subject to any disclaimer, the term of this patent is extended or adjusted under 35 U.S.C. 154(b) by 54 days.

(21) Appl. No.: 09/789,249

(22) Filed: Feb. 20, 2001

(65) Prior Publication Data

US 2002/0112861 A1 Aug. 22, 2002

(51) Int. Cl.[7] ..... E21B 19/00; E21B 19/22; E21B 23/00; E21B 17/02

(52) U.S. Cl. ..... 166/378; 166/379; 166/77.2; 166/242.6

(58) Field of Search ..... 166/77.1, 77.2, 166/242.6, 378, 379, 380; 285/18, 55

(56) References Cited

U.S. PATENT DOCUMENTS

| | | | | |
|---|---|---|---|---|
| 4,685,516 A | | 8/1987 | Smith et al. | |
| 4,810,010 A | | 3/1989 | Jones | |
| 5,330,236 A | | 7/1994 | Peterjohn et al. | |
| 5,392,851 A | | 2/1995 | Arend | |
| 5,435,395 A | | 7/1995 | Connell | |
| 5,469,916 A | * | 11/1995 | Sas-Jaworsky et al. | 138/104 |
| 5,485,745 A | | 1/1996 | Rademaker et al. | |
| 5,944,099 A | * | 8/1999 | Sas-Jaworsky | 166/77.2 |
| 5,988,702 A | | 11/1999 | Sas-Jaworsky | |
| 6,082,454 A | * | 7/2000 | Tubel | 166/250.15 |
| 6,161,622 A | * | 12/2000 | Robb et al. | 166/292 |
| 6,202,749 B1 | * | 3/2001 | Adams et al. | 221/238 |
| 6,332,499 B1 | * | 12/2001 | Kobylinski et al. | 166/242.6 |

OTHER PUBLICATIONS

U.S. patent application Ser. No. 09/534,685; "Coiled Tubing Connector"; Filed Mar. 24, 2000.
Materials Selection & Design News; p. 80; Dated Jul., 2000.
Oil & Gas Journal "Operators Must Become Bigger Stakeholders in Technology"; Dated Jul. 21, 1997.
Drilling Technology; "Behind–Bit Injector, Neutral Drill-pipe Extend Drilling Stepout Distances" p. 80–82 & 146; Dated Jun. 2000.
U.S. patent application Ser. No. 09/421,698; "Internal Flush Coupling for Composite Coiled Tubing"; Filed Oct. 20, 1999.

* cited by examiner

*Primary Examiner*—William Neuder
*Assistant Examiner*—Brian Halford
(74) *Attorney, Agent, or Firm*—John W. Wustenberg; Marlin R. Smith

(57) ABSTRACT

A well tool assembly interconnection method is provided. In a described embodiment, a continuous tubing string has connectors positioned corresponding to desired locations for tool assemblies in a well. The tubing string is wrapped on a reel and transported to a well. As the tubing string is deployed from the reel into the well, the tool assemblies are interconnected between the connectors.

22 Claims, 6 Drawing Sheets

METHODS AND APPARATUS FOR INTERCONNECTING WELL TOOL ASSEMBLIES IN CONTINUOUS TUBING STRINGS

BACKGROUND

The present invention relates generally to operations performed and equipment utilized in conjunction with a subterranean well and, in an embodiment described herein, more particularly provides methods and apparatus for interconnecting well tool assemblies in continuous tubing strings.

Continuous tubing strings, such as coiled tubing strings, have been used for many years in wells. However, one problem with continuous tubing strings is how to interconnect well tool assemblies in the tubing strings.

If a well tool assembly is to be interconnected in a continuous tubing string then, of course, the tubing string must be severed and connections must be made between the tool assembly and the tubing at each end of the tool assembly. With present methods and apparatus, this operation may require many hours to perform.

Continuous tubing strings having lines embedded in their sidewalls have recently become available for use in wells. An example is FIBERSPAR composite coiled tubing available from Fiberspar Spoolable Products, Inc. of Houston, Tex. The FIBERSPAR composite coiled tubing is a composite coiled tubing with eight conductors embedded in its sidewall. Making a connection between this tubing and a tool assembly at a wellsite, where the tubing is severed (i.e., there is no preexisting connector attached to the tubing), typically takes approximately 12 hours to accomplish.

One solution that has been proposed is to interconnect well tool assemblies in the tubing string, and then spool the well tool assemblies on a reel along with the tubing. The reel is then delivered to the wellsite with the tool assemblies already interconnected therein, and the tubing string may be conveyed into the well, without having to make connections at the wellsite. One problem with this approach is that the well tool assemblies may have an outer diameter greater than that of the tubing, in which case spooling the tool assemblies on the reel with the tubing may cause damaging stresses to be imparted to the tubing, and special injector heads are needed to convey the large diameter tool assemblies into the well. Another problem is that many tool assemblies, such as well screens and packers, may be too long and inflexible to be spooled onto the reel.

Therefore, it may be seen that there exists a need for improved methods and apparatus for interconnecting well tool assemblies in continuous tubing strings.

SUMMARY

In carrying out the principles of the present invention, in accordance with embodiments thereof, methods and apparatus are provided which solve the above problems in the art. In one embodiment, a method is provided which permits well tool assemblies to be rapidly interconnected in a continuous tubing string at a wellsite.

In one aspect of the invention, a method is provided in which tool connectors are attached to a tubing string at respective predetermined downhole locations for tool assemblies. The tubing string is wrapped onto a reel with the attached connectors. The tubing string is then deployed into a well from the reel. As the tubing string is deployed, the tool assemblies are connected to the respective connectors.

In another aspect of the invention, a method is provided which permits a line extending through a tubing string to be extended through a tool assembly interconnected into the tubing string. Connectors are used which both connect the line at each end of the tool assembly and structurally attach the tool assembly to the tubing. Such connectors are also used to connect between portions of the tubing.

In a further aspect of the invention, a connector system is provided. A connector of the system includes a gripping structure for grippingly engaging the tubing string, an internal seal structure for sealingly engaging an interior of the tubing string and an external seal structure for sealingly engaging an exterior of the tubing string. Where the tubing string has a line extending therethrough, the connector includes a line connector attached to the line in the tubing string.

In a still further aspect of the invention, a sensor apparatus is provided. The sensor apparatus includes sensors embedded in a sidewall material of a tubular body of the apparatus. The sensors are connected to one or more lines also embedded in the sidewall material.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
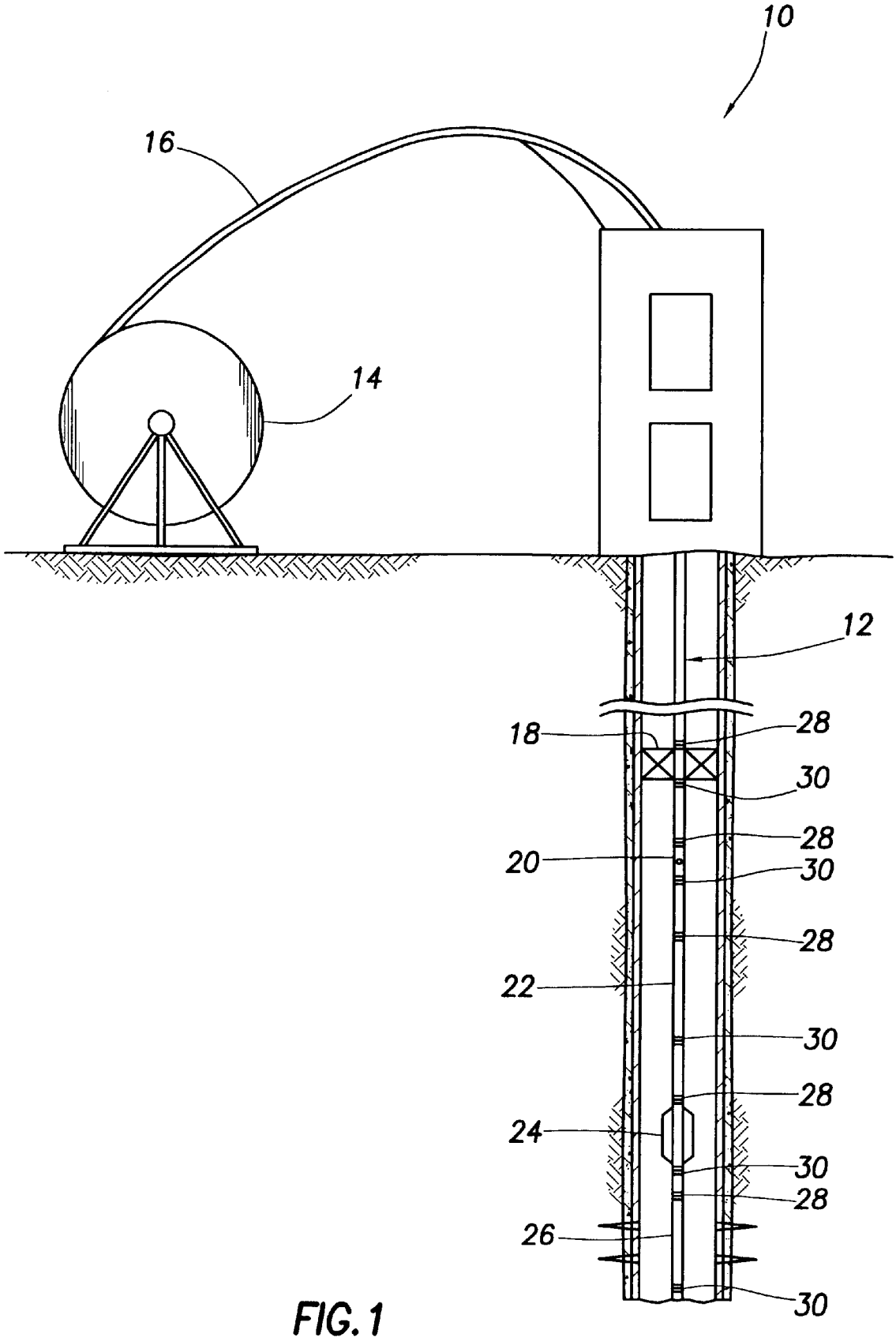
FIG. 1 is a schematic partially cross-sectional side view of an apparatus embodying principles of the present invention.

Representatively illustrated in FIG. 1 is an apparatus 10 which embodies principles of the present invention. In the following description of the apparatus 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the resent invention.

In the apparatus 10, a continuous tubing string 12 is deployed into a well from a reel 14. Since the tubing string 12 is initially wrapped on the reel 14, such continuous tubing strings are commonly referred to as "coiled" tubing strings. As used herein, the term "continuous" means that the tubing string is deployed substantially continuously into a well, allowing for some interruptions to interconnect tool assemblies therein, as opposed to the manner in which segmented tubing is deployed piecemeal into a well in "joints" or in "stands" limited in length by the height of a rig at the well.

Tubing 16 comprises the vast majority of the tubing string 12. The tubing 16 may be made of a metallic material, such as steel, or it may be made of a nonmetallic material, such as a composite material. As described below, the present invention also provides connectors which permit tool assemblies to be interconnected in the tubing string 12 where the tubing 16 is made of a composite material and has lines embedded in a sidewall thereof.

In the past, tool assemblies in a continuous tubing string have either been spliced into the tubing string just before being deployed into a well, or have been wrapped on a reel with the tubing, so that no splicing is needed when the tubing string is deployed into the well. The former method is very time-consuming and inconvenient to perform at the well, especially in those cases where a composite tubing is used, or where lines extend through the tubing string. The second method requires that the tool assemblies be wrapped on the reel, which may be impossible for very long or rigid assemblies, or for assemblies with diameters so large that they interfere with the wrapping of the tubing on the reel, and which requires special expandable injector heads, as described in U.S. Pat. No. 6,082,454, the disclosure of which is incorporated herein by this reference.

In the present apparatus 10, well tool assemblies 18 (a packer), 20 (a valve), 22 (a sensor apparatus), 24 (a well screen) and 26 (a spacer or blast joint) are interconnected in the tubing string 12 without requiring splicing of the tubing 16 at the well, and without requiring the tool assemblies to be wrapped on the reel 14. Instead, connectors 28, 30 are provided in the tubing string 12 above and below, respectively, each of the tool assemblies 18, 20, 22, 24, 26. These connectors 28, 30 are incorporated into the tubing string 12 prior to, or as, it is being wrapped on the reel 14, with each connector's position in the tubing string 12 on the reel 14 corresponding to a desired location for the respective tool assembly in the well.

That is, the connectors 28, 30 are placed in the tubing string 12 at appropriate positions, so that when the tool assemblies 18, 20, 22, 24, 26 are interconnected to the connectors 28, 30 and the tubing string 12 is deployed into the well, the tool assemblies will be at their respective desired locations in the well. The tubing string 12 with the connectors 28, 30 is wrapped on the reel 14 prior to being transported to the well. At the well, the tool assemblies 18, 20, 22, 24, 26 are interconnected between the connectors 28, 30 as the tubing string 12 is deployed into the well from the reel 14. In this manner, the tool assemblies 18, 20, 22, 24, 26 do not have to be wrapped on the reel 14, and the tool assemblies do not have to be spliced into the tubing 16 at the well.

Figure 2:
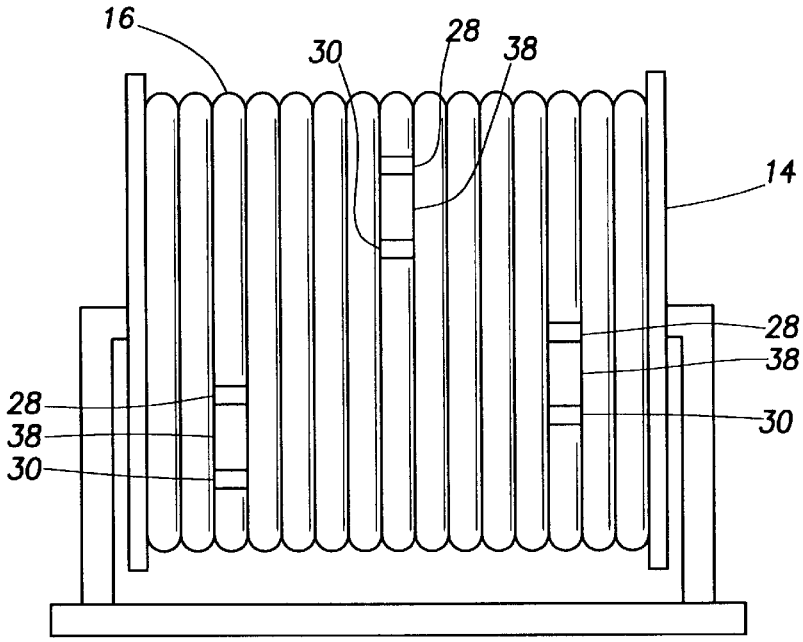
FIG. 2 is an elevational view of a tubing reel utilized in the apparatus of FIG. 1.

Referring additionally now to FIG. 2, a view of the reel 14 is depicted in which the connectors 28, 30 are shown wrapped with the tubing 16 on the reel 14. In this view it may be clearly seen that the connectors 28, 30 are interconnected to the tubing 16 prior to the tubing 16 being wrapped on the reel 14. As described above, the connectors 28, 30 are positioned to correspond to desired locations of particular tool assemblies in a well. Placeholders 38 are used to substitute for the respective tool assemblies between the connectors 28, 30 when the tubing 16 is wrapped on the reel 14.

Figure 3:
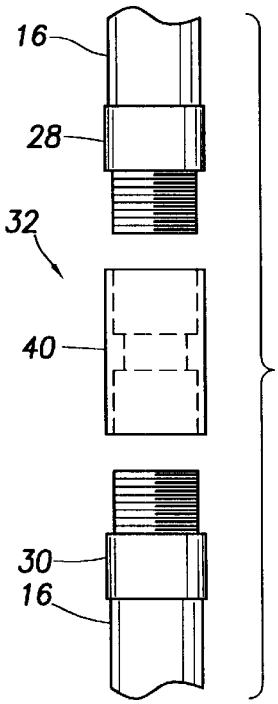
FIGS. 3–5 are side elevational views of alternate connector systems utilized in the apparatus of FIG. 1.
Figure 4:
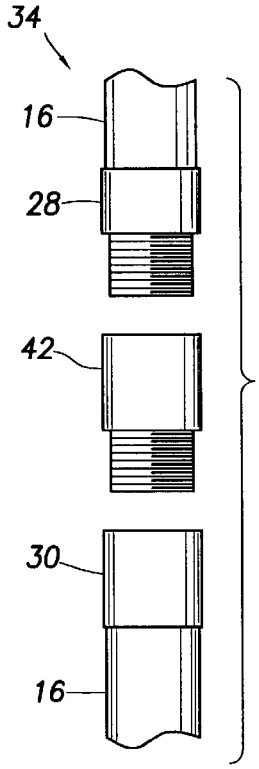
Figure 5:
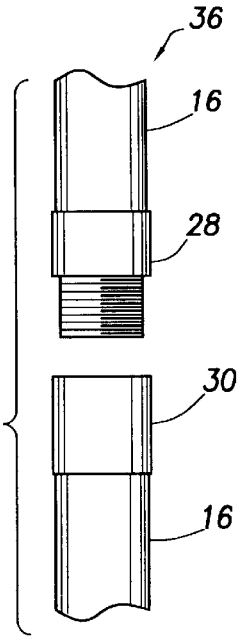

Referring additionally now to FIGS. 3–5, various alternate connector systems 32, 34, 36 are representatively illustrated. In the system 32 depicted in FIG. 3, both of the connectors 28, 30 are male-threaded, and so a placeholder 40 used to connect the connectors 28, 30 together while the tubing string 16 is on the reel 14 has opposing female threads. In the system 34 depicted in FIG. 4, the connector 28 has male threads, the connector 30 has female threads, and so a placeholder 42 has both male and female threads. In the system 36 depicted in FIG. 5, no placeholder is used. Instead, the male-threaded connector 28 is directly connected to the female-threaded connector 30 when the tubing 16 is wrapped on the reel 14.

Thus, it may be clearly seen that a variety of methods may be used to provide the connectors 28, 30 in the tubing string 12. Of course, it is not necessary for the connectors 28, 30 to be threaded, or for any particular type of connector to be used. Any connector may be used in the apparatus 10, without departing from the principles of the present invention.

Figure 6:
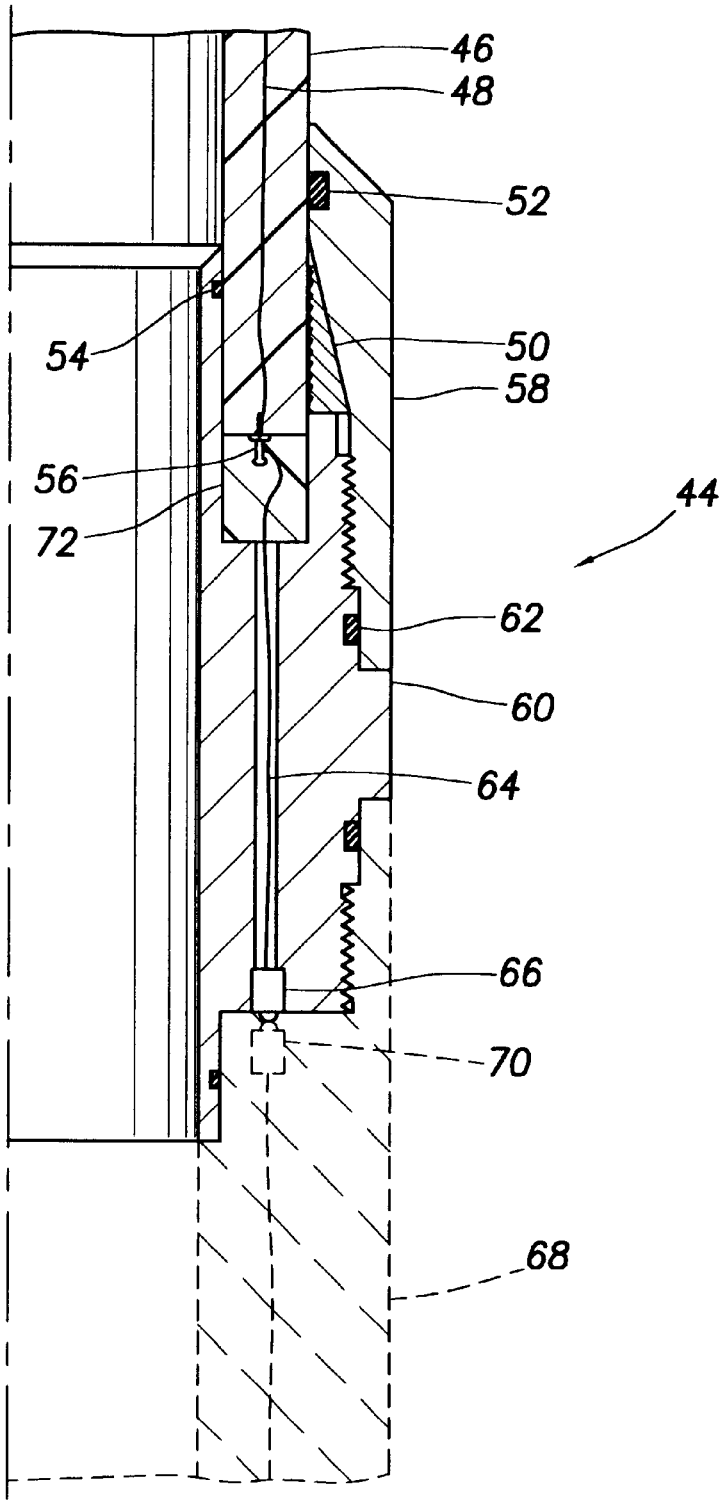
FIG. 6 is a quarter-sectional view of a first connector embodying principles of the present invention.

Referring additionally now to FIG. 6, a connector 44 embodying principles of the present invention is representatively illustrated. The connector 44 may be used for the connector 28 or 30 in the apparatus 10, or it may be used in other apparatus.

The connector 44 is configured for use with a composite tubing 46, which has one or more lines 48 embedded in a sidewall thereof. A slip, ferrule or serrated wedge 50, or multiple ones of these, is used to grip an exterior surface of the tubing 46. The slip 50 is biased into gripping engagement with the tubing 46 by tightening a sleeve 58 onto a housing 60.

A seal 52 seals between the exterior surface of the tubing 46 and the sleeve 58. Another seal 54 seals between an interior surface of the tubing 46 and the housing 60. A further seal 62 seals between the sleeve 58 and the housing 60. In this manner, an end of the tubing 46 extending into the connector 44 is isolated from exposure to fluids inside and outside the connector.

A barb 56 or other electrically conductive member is inserted into the end of the tubing 46, 50 that the barb 56 contacts the line 48. A potting compound 72, such as an epoxy, may be used about the end of the tubing 46 and the barb 56 to prevent the barb 56 from dislodging from the tubing 46 and/or to provide additional sealing for the electrical connection. Another conductor 64 extends from the barb 56 through the housing 60 to an electrical contact 66. The barb 56, conductor 64 and contact 66 thus provide a means of transmitting electrical signals and/or power from the line 48 to the lower end of the connector 44.

Shown in dashed lines in FIG. 6 is a mating connector or tool assembly 68, which includes another electrical contact 70 for transmitting the signals/power from the contact 66 to the connector or tool assembly 68.

Although the line 48 has been described above as being an electrical line, it will be readily appreciated that modifications may be made to the connector 44 to accommodate other types of lines. For example, the line 48 could be a fiber optic line, in which case a fiber optic coupling may be used in place of the contact 66, or the line 48 could be a hydraulic line, in which case a hydraulic coupling may be used in place of the contact 66. In addition, the line 48 could be used for various purposes, such as communication, chemical injection, electrical or hydraulic power, monitoring of downhole equipment and processes, and a control line for, e.g., a safety valve, etc. Of course, any number of lines 48 may be used with the connector 44, without departing from the principles of the present invention.

Figure 7:
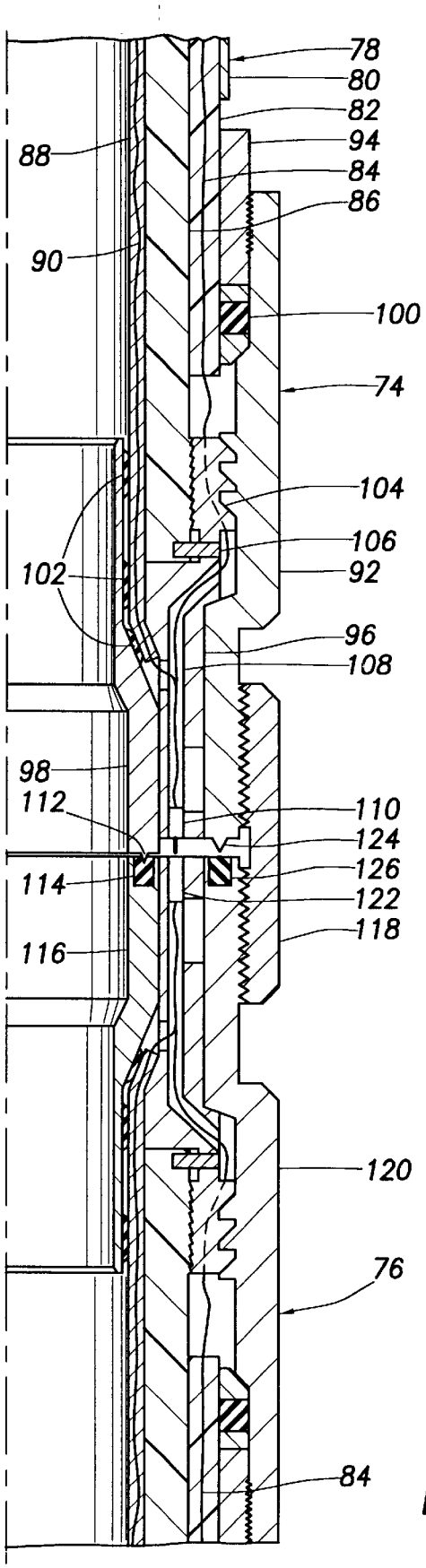
FIG. 7 is a quarter-sectional view of a second connector embodying principles of the present invention.

Referring additionally now to FIG. 7, an upper connector 74 and a lower connector 76 embodying principles of the present invention are representatively illustrated. These connectors 74, 76 may be used for the connectors 28, 30 in the apparatus 10, or they may be used in any other apparatus.

The connectors 74, 76 are designed for use with a composite tubing 78. The tubing 78 has an outer wear layer 80, a layer 82 in which one or more lines 84 is embedded, a structural layer 86 and an inner flow tube or seal layer 88. This tubing 78 is similar to the FIBERSPAR composite coiled tubing referred to above. One or more lines 90 may also be embedded in the seal layer 88.

The wear layer 80 provides abrasion resistance to the tubing 78. The structural layer 86 provides strength to the tubing 78, but the structural layer 86 may be somewhat porous. The layers 82, 88 isolate the structural layer 86 from contact with fluids internal and external to the tubing 78, and provide sealed pathways for the lines 84, 90 in a sidewall of the tubing 78. Thus, if the lines 84, 90 are electrical conductors, the layers 82, 88 provide insulation for the lines. Of course, any type of line may be used for the lines 84, 90, without departing from the principles of the invention.

The upper connector 74 includes an outer housing 92, a sleeve 94 threaded into the housing 92, a mandrel 96 and an inner seal sleeve 98. The upper connector 74 is sealed to an end of the tubing 78 extending into the upper connector 74 by means of a seal assembly 100, which is compressed between the sleeve 94 and the housing 92, and by means of sealing material 102 carried externally on the inner seal sleeve 98.

The mandrel 96 grips the structural layer 86 with multiple collets 104 (only one of which is visible in FIG. 7) having teeth formed on inner surfaces thereof. Multiple inclined surfaces are formed externally on each of the collets 104, and these inclined surfaces cooperate with similar inclined surfaces formed internally on the housing 92 to bias the collets 104 inward into engagement with the structural layer 86. A pin 106 prevents relative rotation between the mandrel 96 and the tubing 78.

The line 84 extends outward from the layer 82 and into the upper connector 74. The line 84 passes between the collets 104 and into a passage 108 formed through the mandrel 96. At a lower end of the mandrel 96, the line 84 is connected to a line connector 110. If the line 90 is provided in the seal layer 88, the line 90 may also extend through the passage 108 in the mandrel 96 to the line connector 110, or to another line connector.

The line connector 110 is depicted as being a pin-type connector, but it may be a contact, such as the contact 66 described above, or it may be any other type of connector. For example, if the lines 84, 90 are fiber optic or hydraulic lines, then the line connector 110 may be a fiber optic or hydraulic coupling, respectively.

When the connectors 74, 76 are connected to each other, an annular projection 112 formed on a lower end of the inner seal sleeve 98 initially sealingly engages an annular seal 114 carried on an upper end of an inner sleeve 116 of the lower connector 76. Further tightening of a threaded collar 118 between the housing 92 and a housing 120 of the lower connector 76 eventually brings the line connector 110 into operative engagement with a mating line connector 122 (depicted in FIG. 7 as a socket-type connector) in the lower connector 76, and then brings an annular projection 124 into sealing engagement with an annular seal 126 carried on an upper end of the housing 120. The seals 114, 126 isolate the line connectors 110, 122 (and the interiors of the connectors 74, 76) from fluid internal and external to the connectors.

Since the lower connector 76 is otherwise similarly configured to the upper connector 74, it will not be further described herein. Note that both of the connectors 74, 76 may be connected to tool assemblies, such as the tool assemblies 18, 20, 22, 24, 26, so that connections to lines may be made on either side of each of the tool assemblies. Thus, the lines 84, 90 may extend through each of the tool assemblies from a connector above the tool assembly to a connector below the tool assembly. This functionality is also provided by the connector 44 described above.

Figure 8:
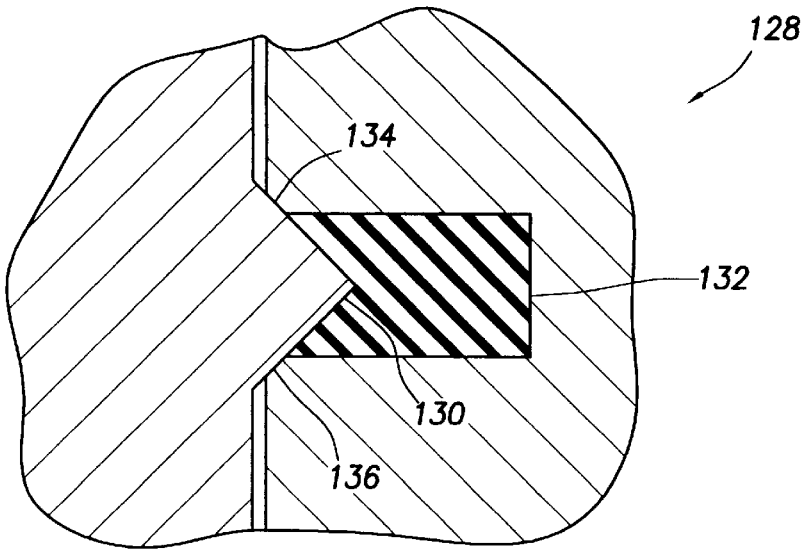
FIG. 8 is an enlarged cross-sectional view of an alternate seal structure for use with the second connector.

Referring additionally now to FIG. 8, an alternate seal configuration 128 is representatively illustrated. The seal configuration 128 may be used in place of either the projection 112 and seal 114, or the projection 124 and seal 126, of the connectors 74, 76.

The seal configuration 128 includes an annular projection 130 and an annular seal 132. However, the projection 130 and seal 132 are configured so that the projection 130 contacts shoulders 134, 136 to either side of the seal 132. This contact prevents extrusion of the seal 132 due to pressure, and also provides metal-to-metal seals between the projection 130 and the shoulders 134, 136.

Figure 9:
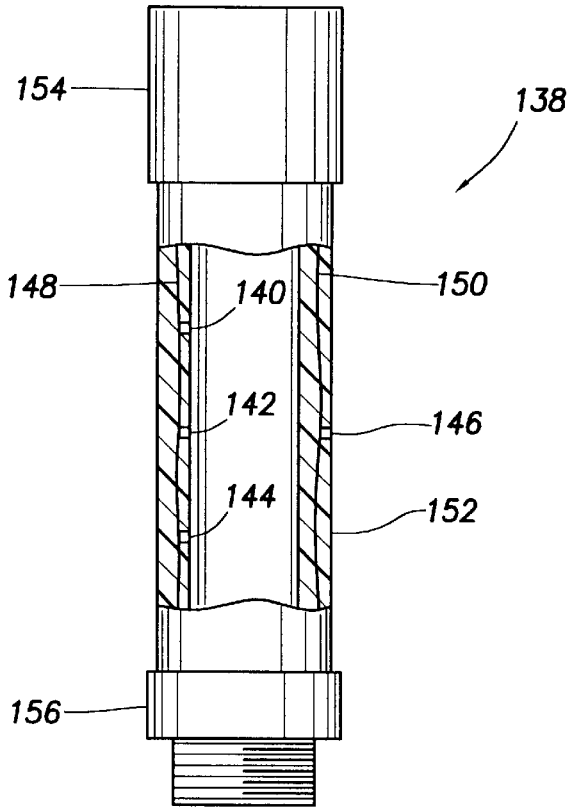
FIG. 9 is a partially cross-sectional view of a sensor apparatus embodying principles of the present invention.

Referring additionally now to FIG. 9, an example is representatively illustrated of a tool assembly 138 which may be interconnected in a continuous tubing string. The tool assembly 138 is a sensor apparatus. It includes sensors 140, 142, 144, 146 interconnected to lines 148, 150 embedded in a sidewall material of a tubular body 152 of the tool assembly 138.

The sensors 140, 142, 144, 146 are also embedded in the sidewall material of the body 152. The sensors 140, 142, 144 sense parameters internal to the body 152, and the sensor 146 senses one or more parameter external to the body 152. Any type of sensor may be used for any of the sensors 140, 142, 144, 146.

For example, pressure and temperature sensors may be used. It would be particularly advantageous to use a combination of types of sensors for the sensors 140, 142, 144, 146 which would allow computation of values, such as multiple phase flow rates through the tool assembly 138.

As another example, it would be advantageous to use a seismic sensor for one or more of the sensors 140, 142, 144, 146. This would make available seismic information previously unobtainable from the interior of a sidewall of a tubing string.

Note that the sidewall material is preferably a nonmetallic composite material, but other types of materials may be utilized, in keeping with the principles of the invention. In particular, the body 152 could be a section of composite tubing, in which the sensors 140, 142, 144, 146 have been installed and connected to the lines 148, 150.

The lines 148, 150 may be any type of line, including electrical, hydraulic, fiber optic, etc. Additional lines (not shown in FIG. 9) may extend through or into the tool assembly 138. Connectors 154, 156 permit the tool assembly 138 to be conveniently interconnected in a tubing string. For example, the connector 76 described above may be used for the connector 154, and the connector 74 described above may be used for the connector 156. Via the connectors 154, 156, the lines 148, 150 are connected to lines extending through tubing or other tool assemblies attached to each end of the tool assembly 138.

Figure 10:
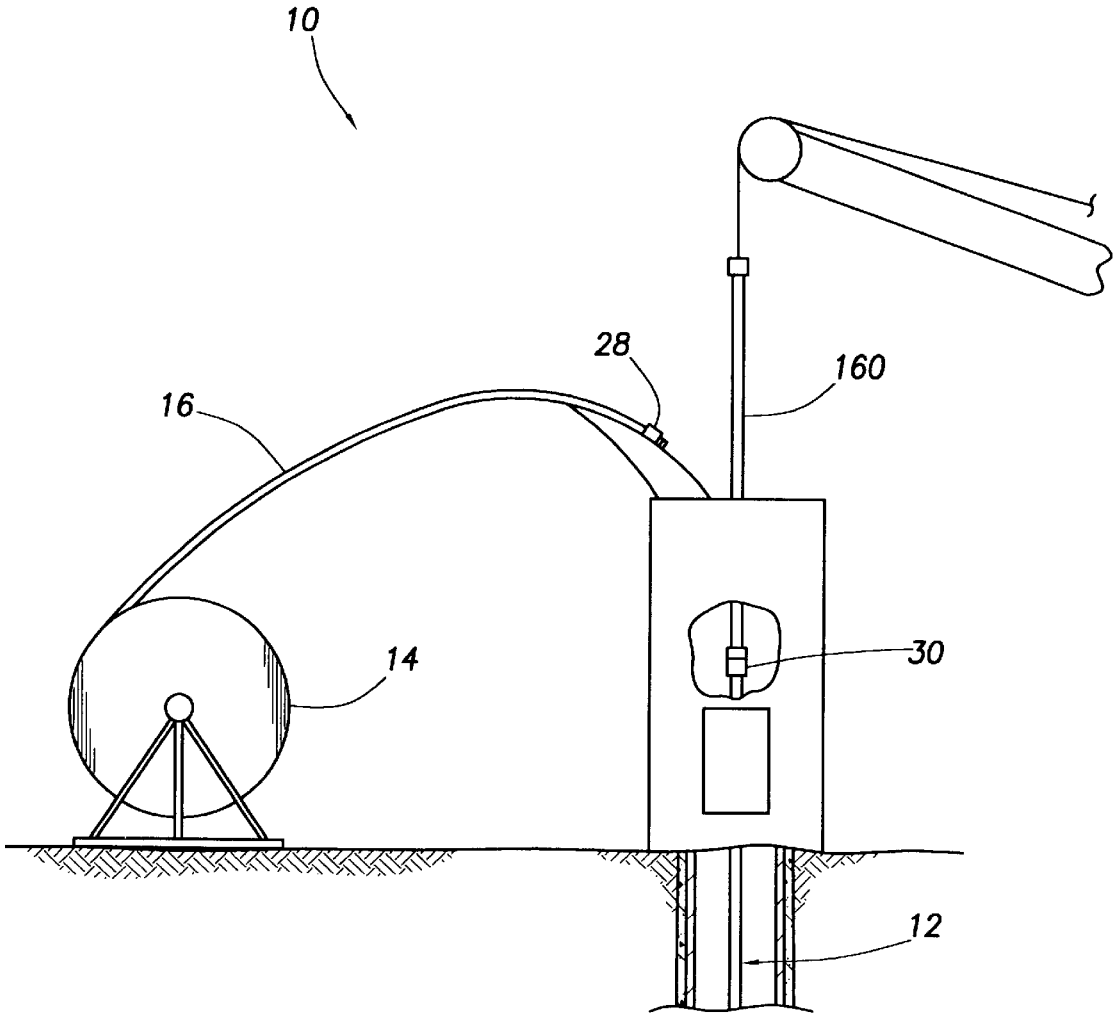
FIG. 10 is a schematic partially cross-sectional side view of a variation of the apparatus of FIG. 1.

Referring additionally now to FIG. 10, the apparatus 10 is representatively illustrated wherein a tool assembly 160 is being interconnected into the tubing string 12. The tool assembly 160 is too long, too rigid, or too large in diameter to be wrapped on the reel 14 with the tubing 16.

Connectors 28, 30 are separated (and a placeholder 38 is removed, if necessary) prior to interconnecting the tool assembly 160 in the tubing string 12. The tool assembly 160 is connected to the lower connector 30, the tubing string 12 is lowered, and then the tool assembly 160 is connected to the upper connector 28. As described above, the connectors 28, 30 are provided already connected to the tubing 16 when the tubing 16 is wrapped on the reel 14 and transported to the well, so that when the tool assembly 160 is interconnected between the connectors 28, 30 and the tubing string 12 is deployed into the well, the tool assembly 160 will be appropriately positioned in the well.

In one embodiment of the present invention, the tool assembly 160 is a spacer used to space out other equipment in the tubing string 12. An example of this use is shown in FIG. 1, wherein the tool assembly 26 may be used to correct or adjust the spacing between, e.g., the well screen 24 and perforations in the well. Such corrections or adjustments in tool spacings in the tubing string 12 are conveniently made at the wellsite by means of the tool assembly 160 or 26. Note that, when used in this manner, the tool assembly 160 or 26 is not necessarily too long, too rigid, or too large in diameter to be wrapped on the reel 14 with the tubing 16.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A method of interconnecting a plurality of well tool assemblies in a continuous tubing string, the method comprising the steps of:

attaching a pair of tool connectors comprising a first tool connector and a second tool connector to the tubing string where each one of the tool assemblies will be located;

wrapping the tubing string with the attached tool connectors onto a reel;

unwrapping the tubing string with the attached tool connectors from the reel; and interconnecting each one of the tool assemblies in the tubing string between the respective pair of tool connectors after the tubing string has been unwrapped from the reel.

2. The method of claim 1, further comprising the steps of:

connecting each one of the first tool connectors to the respective second tool connector before the step of wrapping the tubing string; and disconnecting each one of the first tool connectors from the respective second tool connector after the step of unwrapping the tubing string.

3. The method of claim 2, wherein the step of connecting comprises the steps of:

providing a placeholder;

connecting one of the first tool connectors to the placeholder; and connecting the respective second tool connector to the placeholder.

4. The method of claim 2, wherein the step of connecting comprises the step of connecting one of the first tool connectors directly to the respective second tool connector.

5. The method of claim 1, further comprising the step of deploying the tubing string containing the interconnected tool assemblies into a well.

6. The method of claim 1, wherein the tubing string is coiled tubing.

7. The method of claim 1, wherein the tubing string is composite coiled tubing.

8. A method of interconnecting a well tool assembly in a continuous tubing string severed at a location for the tool assembly, the method comprising the steps of:

attaching a first tool connector to the tubing string at a first end of the severed tubing string;

attaching a second tool connector to the tubing string at a second end of the severed tubing string;

wrapping the tubing string with the attached first and second tool connectors onto a reel;

unwrapping the tubing string with the attached first and second tool connectors from the reel; and interconnecting the tool assembly in the tubing string between the first and second tool connectors after the tubing string has been unwrapped from the reel.

9. The method of claim 8, further comprising the steps of:

connecting the first tool connector to the second tool connector before the step of wrapping the tubing string; and disconnecting the first tool connector from the second tool connector after the step of unwrapping the tubing string.

10. The method of claim 9, wherein the step of connecting comprises the steps of:

providing a placeholder;

connecting the first tool connector to the placeholder; and connecting the second tool connector to the placeholder.

11. The method of claim 10, wherein the step of disconnecting comprises the steps of:

disconnecting the first tool connector from the placeholder; and disconnecting the second tool connector from the placeholder.

12. The method of claim 9, wherein the step of connecting comprises the step of connecting the first tool connector directly to the second tool connector.

13. The method of claim 12, wherein the step of disconnecting comprises the step of disconnecting the first tool connector from the second tool connector.

14. The method of claim 8, further comprising the step of deploying the tubing string containing the interconnected tool assembly into a well.

15. The method of claim 8, wherein the first tool connector comprises means for connecting a line in the tubing string to the tool assembly.

16. The method of claim 15, wherein the line is a selected one of a communication line, an injection line, a power line, a control line, and a monitoring line.

17. The method of claim 15, wherein the line is a selected one of a hydraulic line, an electrical line, and a fiber optic line.

18. The method of claim 8, wherein the tubing string is coiled tubing.

19. The method of claim 8, wherein the tubing string is composite coiled tubing.

20. The method of claim 8, wherein the first tool connector has a first end and a second end, the first end of the first tool connector is attached to the first end of the severed tubing string, and the second end of the first tool connector is threaded.

21. The method of claim 20, wherein the second end of the first tool connector is male-threaded.

22. The method of claim 1, wherein the second end of the first tool connector is female-threaded.

* * * * *

UNITED STATES PATENT AND TRADEMARK OFFICE

CERTIFICATE OF CORRECTION

PATENT NO. : 6,561,278 B2
DATED : May 13, 2003
INVENTOR(S) : Henry L. Restarick et al.

It is certified that error appears in the above-identified patent and that said Letters Patent is hereby corrected as shown below:

Title page,
Insert the following: -- Assignee: Halliburton Energy Services, Inc., Duncan, OK (US) --.

Signed and Sealed this

Fourteenth Day of October, 2003

JAMES E. ROGAN
*Director of the United States Patent and Trademark Office*